United States Patent [19]

Hall

[11] Patent Number: 4,684,953

[45] Date of Patent: Aug. 4, 1987

[54] REDUCED HEIGHT MONOPOLE/CROSSED SLOT ANTENNA

[75] Inventor: Edward A. Hall, St. Louis, Mo.

[73] Assignee: McDonnell Douglas Corporation, St. Louis, Mo.

[21] Appl. No.: 712,157

[22] Filed: Mar. 15, 1985

Related U.S. Application Data

[63] Continuation-in-part of Ser. No. 569,265, Jan. 9, 1984, Pat. No. 4,587,524.

[51] Int. Cl.[4] ..... H01Q 21/00

[52] U.S. Cl. ..... 343/725; 343/729

[58] Field of Search ..... 343/725, 729

[56] References Cited

U.S. PATENT DOCUMENTS 4,443,802 4/1984 Mayes ..... 343/729

OTHER PUBLICATIONS

Mayes & Cwik, The Hybrid Slot, a Low-Profile Energy-Density Antenna.

Stutzman & Thiele, Antenna Theory and Design.

Cwik, 1979, The Hybrid Slot Antenna.

*Primary Examiner*—Robert E. Wise

*Attorney, Agent, or Firm*—Rogers, Howell, Moore & Haferkamp

[57] ABSTRACT

A reduced height monopole/crossed slot antenna having generally parallel spaced ground planes, the upper one of which has a capacitively loaded slot therein formed by crossed slot portions. A stripline is located between the ground planes offset toward the upper ground plane, and is formed by crossed stripline portions. A monopole extends from the intersection of the crossed stripline portions through the intersection of the crossed slot portions orthogonally to the upper ground plane, and is top hat loaded at the outer end thereof. The stripline is fed at selective ends thereof.

12 Claims, 9 Drawing Figures

FIG. 1
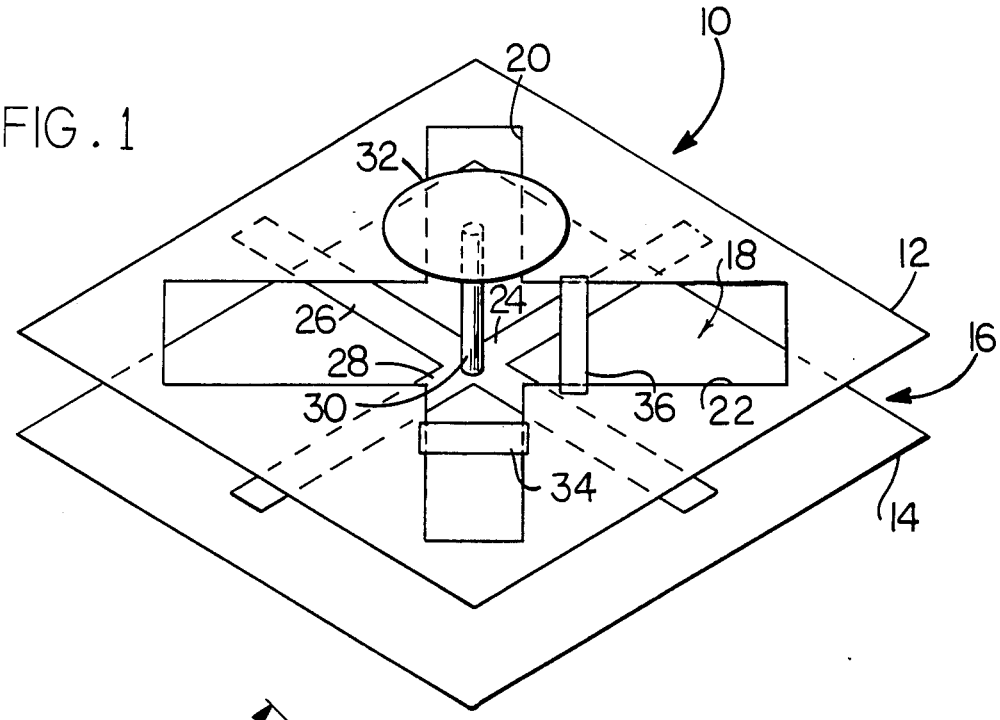
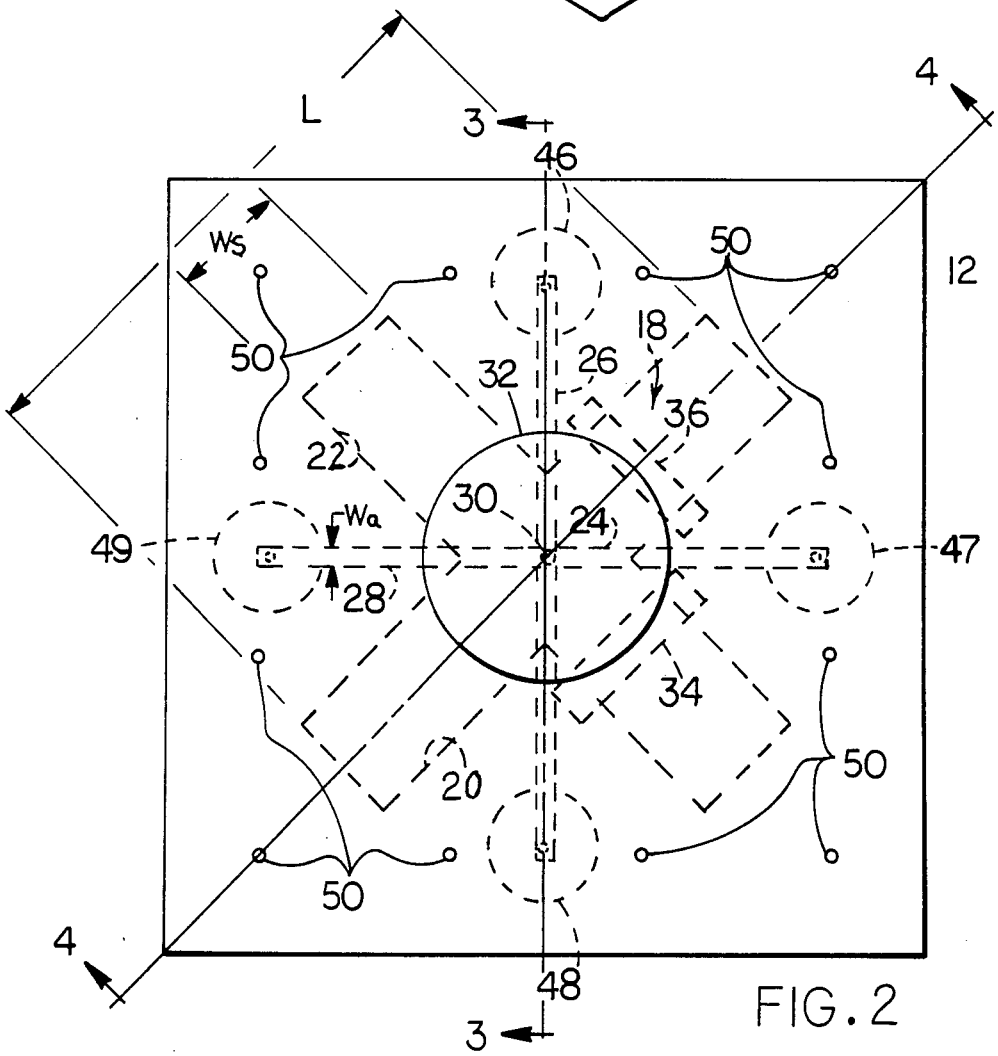
FIG. 2

REDUCED HEIGHT MONOPOLE/CROSSED SLOT ANTENNA

REFERENCE TO RELATED APPLICATIONS

This application is a continuation-in-part of U.S. patent application Ser. No. 569,265, filed Jan. 9, 1984, now U.S. Pat. No. 4,587,524, incorporated herein by reference.

BACKGROUND AND SUMMARY OF THE INVENTION

This invention relates to monopole/slot antennas, and more particularly to such antennas where the height of the monopole is reduced by the addition of compensating features and the radiation pattern "steering" capability is increased with modification to the slot and stripline configurations.

By way of background, unidirectional antennas with pattern rotation or "steering" capability are known in the art. One such antenna is described in a thesis entitled "The Hybrid- Slot Antenna" by Thomas Allen Cwik, B.S., University of Illinois, 1979. In that publication, beginning at page 66, there is described a four port hybrid slot antenna having upper and lower ground planes and a stripline midway therebetween. The upper ground plane has an annular slot surrounding a conductive disk located centrally of that plane. Orthogonal rectangular slots intersect the annular slot at their centers. The stripline consists of a pair of stripline portions parallel to the ground planes and midway therebetween. The stripline portions are oriented 90° to each other and 45° to the longitudinal axis of each rectangular slot and crossing directly under the center of the disk. A paper thin piece of mylar is placed between the stripline portions to achieve isolation. The stripline is fed through ports at the ends of the stripline portions. The antenna had no monopole. According to the publication, by successively feeding two adjacent ports in phase and with equal magnitudes, the antenna produces a cardioid pattern successively steered 90°.

The antenna of the present invention has certain advantages over that described in the publication, in that it provides beam steering with improved structure and performance attained by incorporating important features described in said co-pending application, such as an offset stripline and capacitively loaded slot.

Hence, in said co-pending application Ser. No. 569,265 there is described a reduced height monopole/-slot antenna with substantial advantages over other monopole/slot antennas. In accordance with the antenna of that application, the height of the monopole is substantially reduced while maintaining the impedance and cardioid radiation characteristics over a wide bandwidth. This is accomplished by offsetting the stripline toward the slotted ground plane, and capacitively loading the slot. The result is a wide bandwidth antenna that develops a highly directive cardioid radiation pattern. It has low volume, excellent form factor, and easy producibility. The wide bandwidth occurs at a low input VSWR over an extremely wide frequency range, and a cardioid pattern in the antenna ground plane with a deep null is maintained over a wide bandwidth. The monopole element, which protrudes above the antenna in the full height monopole/slot antenna, is significantly reduced in height by electrical loading. Therefore, for many applications, the antenna of said application can be flush mounted with no protrusions above the mounting surface.

The antenna of the present invention incorporates these important features of the antenna of the co-pending application, including the offset stripline and capacitively loaded slot, while providing the additional advantage of more beam steering flexibility.

In accordance with the present invention, the slot is formed of two orthogonal radiating rectangular slot portions in the upper ground plane. The stripline is formed of two stripline portions, one orthogonal to the other with the stripline oriented at 45° out of alignment with the longitudinal axes of the slot portions. The monopole extends from the intersection of the stripline portions and through the center of intersection of the cavity portions orthogonal to the upper ground plane. Connectors or ports are provided at each end of each stripline portion for selectively feeding the stripline. As with the invention of the co-pending application, the monopole is top hat loaded, the stripline is offset toward the upper ground plane, and the slot is capacitively loaded. Through various combinations of feeding the stripline, various beam positions and radiation patterns are obtained, all while retaining the advantages described in the co-pending application. The result is a reduced height monopole/crossed slot antenna with stable, deep null, cardioid radiation patterns, with beam steering capability, and a low VSWR over a wide bandwidth. The antenna has low volume, excellent form factor, and easy producibility.

BRIEF DESCRIPTION OF THE DRAWINGS

FIG. 1 is a schematic of a reduced height monopole/-crossed slot antenna of the present invention;

FIG. 2 is a plan view of a reduced height monopole/-crossed slot antenna of the present invention in somewhat more detail as shown in FIG. 1;

DETAILED DESCRIPTION OF A PREFERRED EMBODIMENT

Figure 3:
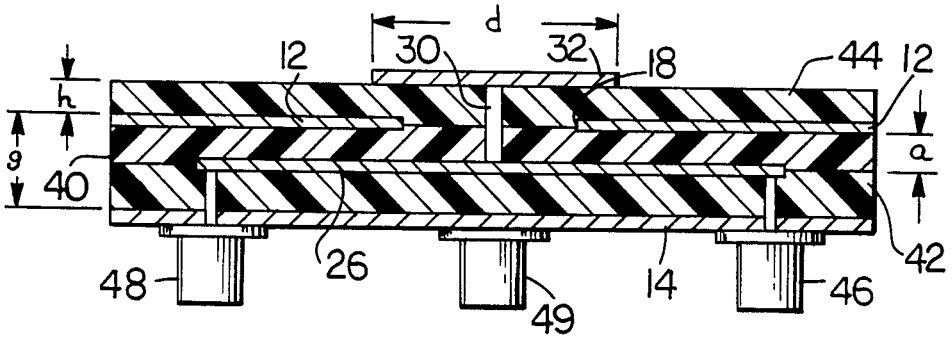
FIG. 3 is a view in section taken generally along the line 3—3 of FIG. 2.
Figure 4:
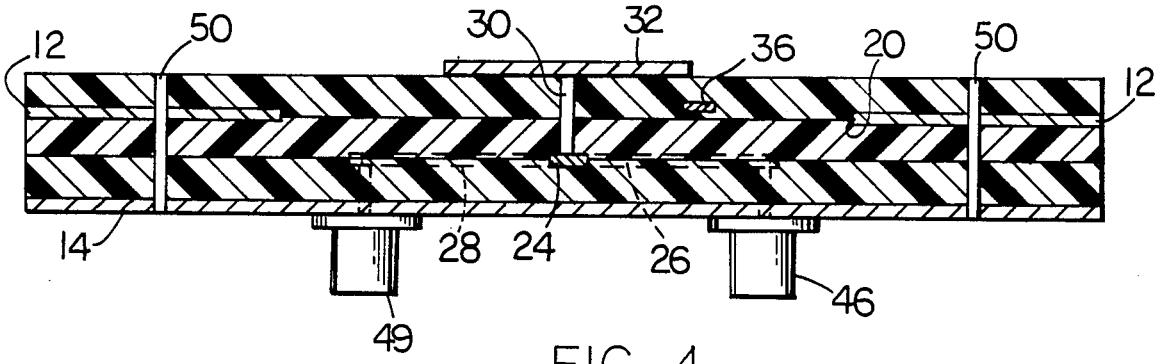
FIG. 4 is a view in section taken generally along the line 4—4 of FIG. 2.

A reduced height monopole/crossed slot antenna 10 of the present invention is shown schematically in FIG. 1 and in more detail in FIGS. 2 through 4. The antenna includes generally parallel spaced ground planes 12 and 14 defining a cavity 16 therebetween. The upper ground plane 12 has a slot 18 having slot portions 20 and 22. These slot portions are each rectangular with one orthogonal to the other and intersecting or crossing at their centers. The longitudinal axes of the slot portions are aligned along the diagonals of the upper ground plane.

Located between the two ground planes is a stripline 24 of a conductive material. The stripline includes stripline portions 26 and 28 parallel to the ground plane, each consisting of relatively long narrow strips, one orthogonal to the other and intersecting or crossing at their centers. The stripline is offset toward the upper ground plane 12 and is oriented with the stripline portions 45° out of alignment with the longitudinal axes of the slot portions. A monopole 30 is connected at the center of the stripline, such that the monopole connects with both stripline portions, and extends therefrom through the slot 18 at the center of the intersection of the slot portions orthogonal to the ground plane 12. At the outer end of the monopole is a conductive disk or "top hat" 32. Each of the slot portions 20 and 22 is capacitively loaded across its width near the monopole as shown at 34 and 36.

The construction of the antenna of the present invention includes dielectric layers 40 and 42 between the ground planes 12 and 14, and a dielectric layer 44 between the upper ground plane 12 and the top hat 32, such that the upper surface of the dielectric layer 44 is substantially flush with the top hat. The ends of the stripline portions are connected to suitable ports or connectors such as coaxial connectors 46, 47, 48 and 49 on the bottom side of the antenna. Spaced conductive posts 50 extend through the layers and serve both to join the layers together and to define the perimeter of the cavity 16. These posts are conductively joined to the two ground planes. Although capacitance is shown across each slot portion at only one side of the monopole, additional capacitance could be applied to the other side of the monopole. In certain special cases, the capacitance formed across the slot by the monopole top hat is sufficient and no additional capacitance is needed.

With the antenna of the present invention there is the ability to rotate or steer the cardioid radiation pattern by selectively driving and loading the stripline at the ports 46 through 49 giving the antenna "beam steering" capability.

To explain more fully how the antenna functions, the monopole radiates an omnidirectional pattern with constant phase in all ground plane directions. The slot radiates a Figure 8 pattern with a 180° phase reversal between lobes. When both elements are excited, the patterns sum in one direction and subtract in the opposite direction. Where the amplitudes match and phases are reversed, a null results. This condition is exactly met only in one direction, which lies in a ground plane direction. With a single slot configuration as described in the co-pending application, reversing the direction of feed on the stripline causes the phase on the slot pattern to change polarity, which produces a 180° change in the direction of the pattern null. With the slot and stripline configurations of the present invention, the selection of more beam directions is made possible to provide more beam steering flexibility.

Figure 5:
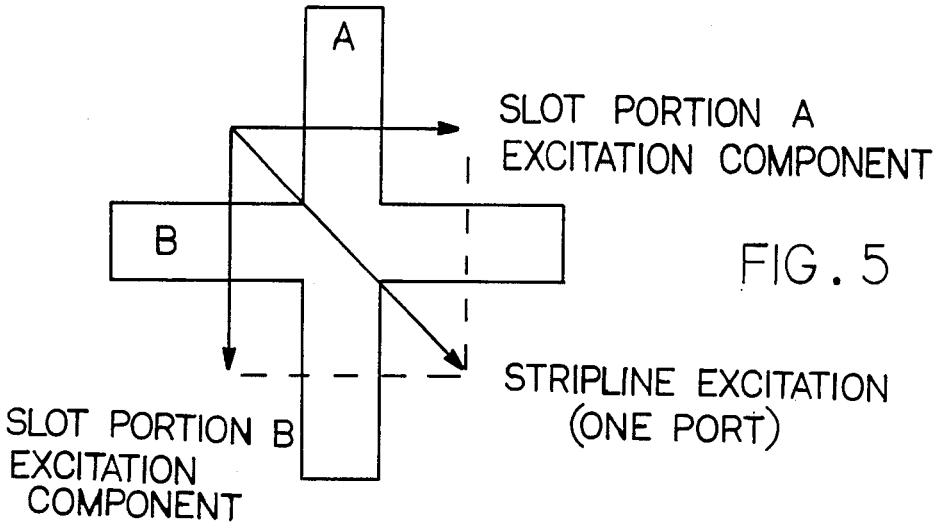
FIG. 5 is a vector diagram illustrating the result of exciting one stripline connector.
Figure 7:
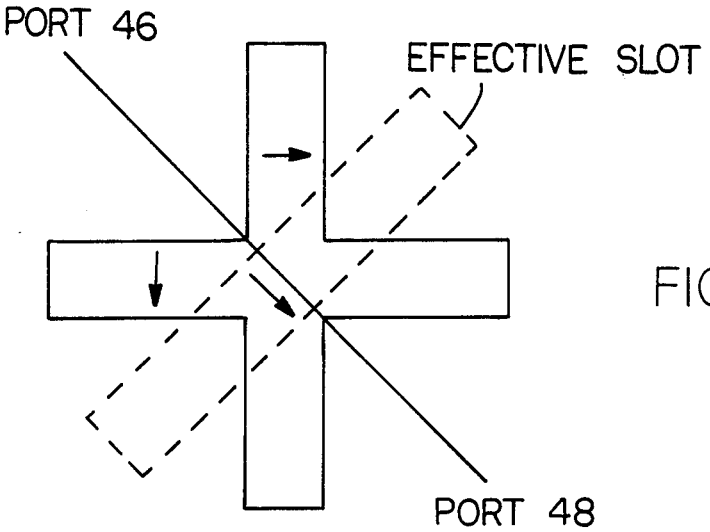
FIG. 7 is a diagram illustrating the "effective slot" formed as a result of exciting two adjacent connectors of the stripline.

Hence, one or both slot portions can be excited by the stripline feed by selecting various combinations of driving ports 46 through 49. Ports not driven are terminated in a matched load. Driving port 46 causes excitation current of the stripline to cross the narrow dimensions of both slot portions, causing both slot portions to radiate. This is illustrated with the vector diagram of FIG. 5. An "effective slot" radiator is formed as shown in FIG. 7. This effective slot radiates a Figure 8 pattern aligned with the stripline portion 26 with the 180° phase lobe away from the feed port. The total radiation pattern, including monopole radiation, will be cardioid with the null directed along the stripline portion 26 away from the feed port. Feeding the opposite end of the stripline (port 48) reverses the null direction.

Figure 6:
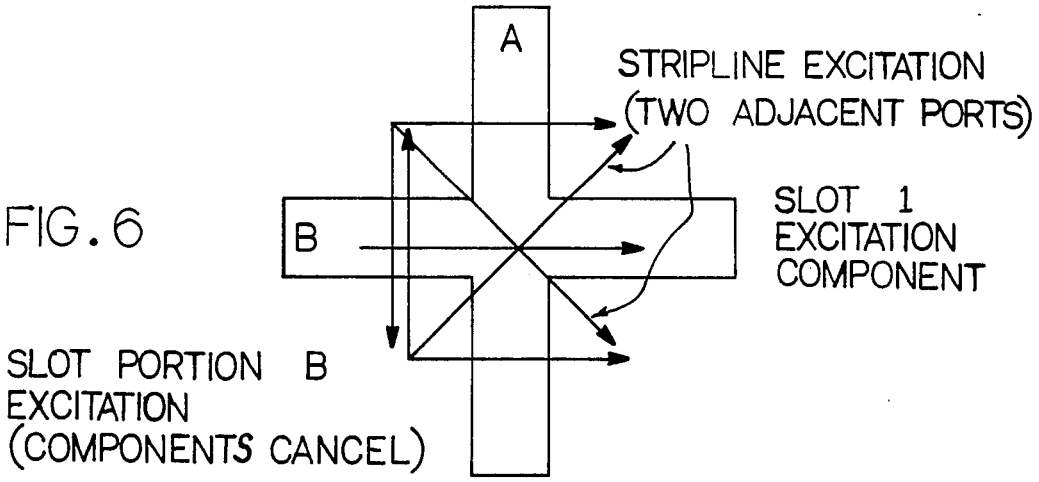
FIG. 6 is a vector diagram illustrating the result of driving two adjacent connectors of the stripline.
Figure 8:
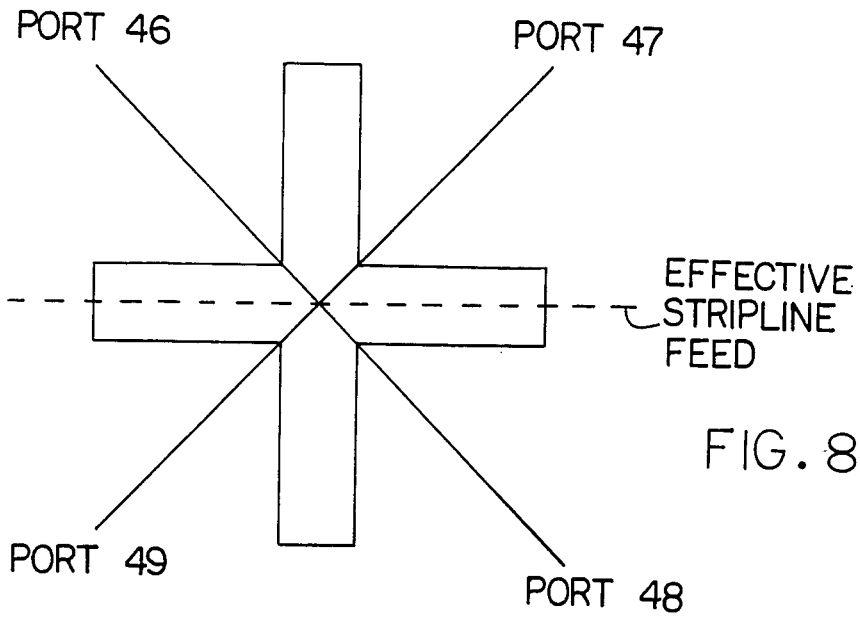
FIG. 8 is a diagram illustrating an "effective stripline" when two adjacent connectors are excited.

Driving two adjacent ports, such as ports 46 and 49, causes a net excitation that excites only one slot. This is illustrated with the vector diagram of FIG. 6. The two stripline portions appear as one effective stripline as illustrated in FIG. 8. The slot Figure 8 pattern is aligned with this effective stripline with the 180° phase lobe away from the two feed ports. The resulting cardioid radiation pattern has the null directed along the effective stripline feed. Feeding ports 47 and 48 reverses the effective stripline and the direction of the null. In all cases, the monopole is excited through contact with the stripline.

Thus by selectively driving the ports, the beam direction of the cardioid radiation pattern produced by the antenna can be varied. Through various combinations of feeding one or two adjacent ports with equal power, a total of eight cardioid radiation positions are obtained. These combinations are summarized as follows, with zero degrees defined as aligned with slot portion 22 (FIG. 2) between ports 46 and 49 (positive angles are clockwise rotation):

| Port 46 | Port 47 | Port 48 | Port 49 | Null Direction |
|---|---|---|---|---|
| 1 | 0 | 0 | 0 | −135° |
| 1 | 1 | 0 | 0 | −90° |
| 0 | 1 | 0 | 0 | −45° |
| 0 | 1 | 1 | 0 | 0° |
| 0 | 0 | 1 | 0 | +45° |
| 0 | 0 | 1 | 1 | +90° |
| 0 | 0 | 0 | 1 | +135° |
| 1 | 0 | 0 | 1 | +180° |

In addition to these, either slot portion can be selected by feeding opposite ends of its stripline portion out of phase. Under this condition, the monopole will contact the stripline at a null and will not be excited. A Figure 8 radiation pattern results. Also, by feeding all four ports with equal amplitude, only the monopole is excited and an omnidirectional pattern results.

By way of example, a reduced height monopole/crossed slot antenna of the present invention was constructed for a resonant frequency of 1.0 GHz with the following dimensions with reference to FIGS. 2–4.

the spacing g between the upper and lower ground planes equals 0.397 cm.;

the distance a between the stripline and the upper ground plane equals 0.079 cm.;

the width Wa of the stripline equals 0.229 cm.;

the height h of the monopole above the upper ground plane equals 0.635 cm.;

the diameter d of the top hat equals 3.334 cm.;

the width Ws of each slot portion equals 1.588 cm.;

the length l of each slot portion equals 7.62 cms.;

the spacing s of the posts 50 equals 2.54 cms. such that the cavity dimensions are 7.62 cms. wide by 7.62 cms. long by 0.397 cms. thick. The slot was capactively loaded.

Figure 9:
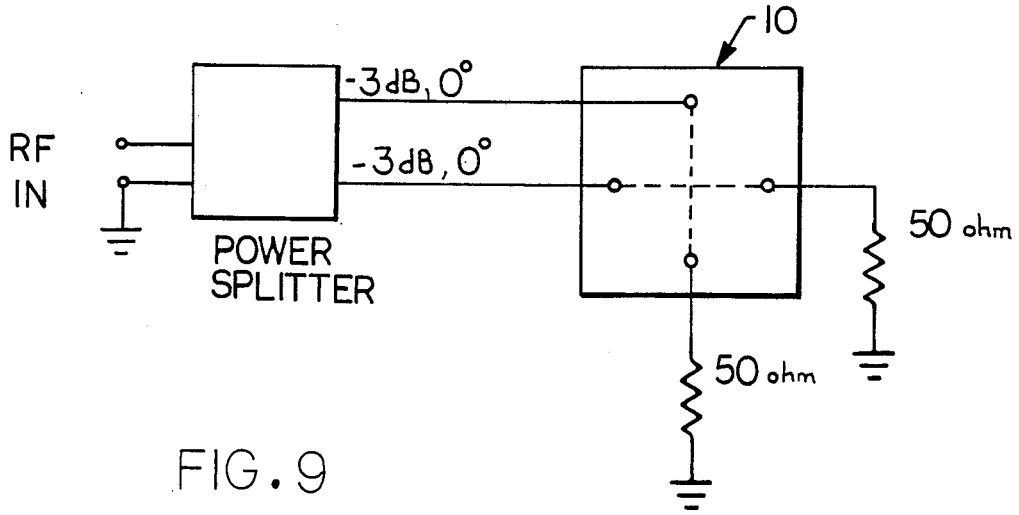
FIG. 9 is a driver circuit for driving the stripline.

The input VSWR was measured while feeding two adjacent ports with a power divider as shown in FIG. 9. The antenna showed a VSWR of less than 1.8 to 1 within the frequency range of 0.6 to 1.5 GHz. The radiation patterns of the antenna were measured by driving two adjacent ports with the power driver of FIG. 9. In each case the pattern was a cardioid. As the ports were driven in succession, such as by first driving the ports 46, 47, then the ports 47, 48, then the ports 48, 49, and finally the ports 49, 46, the null of beam direction rotated 360° at 90° intervals.

The antenna of the present invention can be used as a single element antenna to provide excellent impedance bandwidth and an exceptionally stable unidirectional pattern that is steerable. These properties make the antenna useful as a communications antenna. The steerable null in the radiation pattern can be used to provide covertness or to eliminate an interfering signal. The stable radiation pattern makes the antenna useful for a wide bandwidth direction finding application. A single antenna can be used with an amplitude comparison system to determine direction to an emitter and eliminate 180° ambiguities by switching the pattern to four directions.

Thus, there has been described a reduced height monopole/crossed slot antenna which retains the advantages of the antenna described in the co-pending application, with additional steering or pattern rotation capability.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A monopole/slot antenna having generally parallel spaced ground planes, the upper one of which having a slot therein, a stripline located between the ground planes generally parallel thereto and offset toward the slotted ground plate, and a monopole conductively connected to and extending from the stripline through said slot generally orthogonally to the upper ground plane, said slot having first and second elongated slot portions, one being orthogonal to the other and intersecting generally at the centers thereof, said stripline having first and second stripline portions, one being orthogonal to the other and conductively intersecting generally at the centers thereof, said stripline portions being oriented approximately 45° out of physical alignment with the longitudinal axis of said slot portions, said monopole extending from the intersection of said stripline portions through the slot, and means for feeding said stripline at selected ends thereof.

2. The antenna of claim 1 wherein said stripline portions are of equal length, and said slot portions are of equal length.

3. The antenna of claim 1 wherein each slot portion is generally rectangular, and further comprising capacitance means connected across the narrow dimension of at least one slot portion.

4. The antenna of claim 3 further comprising capacitance means connected across the narrow dimension of each slot portion.

5. The antenna of claim 1 wherein said monopole extends through said slot generally at the intersection of said slot portions.

6. The monopole/slot antenna of claim 1 wherein said monopole is top hat loaded at the outer end thereof.

7. A monopole/slot antenna having generally parallel spaced ground planes, the upper one of which having a slot therein, a stripline located between the ground planes generally parallel thereto and off-set toward the slotted ground plane, and a monopole conductively connected to and extending from the stripline and through said slot generally orthogonally to the upper ground plane and being top hat loaded at the outer end thereof, said slot having first and second generally rectangular slot portions, one intersecting with the other, said stripline having first and second stripline portions, one conductively intersecting with the other, and means for feeding the stripline at selected ends thereof.

8. The antenna of claim 7 wherein the slot portions are orthogonal, and wherein the stripline portions are orthogonal.

9. The antenna of claim 8 wherein the monopole is connected to the stripline at the center of intersection of the stripline portions, and extends through the slot at the center of intersection of the slot portions.

10. The antenna of claim 9 wherein the stripline portions are oriented approximately 45° out of physical alignment with the longitudinal axes of the slot portions.

11. A monopole/slot antenna having generally parallel spaced ground planes, the upper one of which having a slot therein, a stripline located between the ground planes generally parallel thereto, and a monopole conductively connected to and extending from the stripline and through said slot generally orthogonally to the upper ground plane, said slot having first and second generally rectangular slot portions, one intersecting with the other, said stripline having first and second stripline portions, one conductively intersecting with the other, and means for feeding the stripline at selected ends thereof.

12. The monopole/slot antenna of claim 11 wherein said monopole is top hat loaded at the outer end thereof.

* * * * *